United States Patent [19]

Tongel

[11] 4,315,789

[45] Feb. 16, 1982

[54] METHOD OF TRANSFERRING MAT FROM A FORMING SURFACE STATION TO A BONDING STATION

[75] Inventor: Richard R. Tongel, Pittsburgh, Pa.

[73] Assignee: PPG Industries, Inc., Pittsburgh, Pa.

[21] Appl. No.: 159,087

[22] Filed: Jun. 13, 1980

[51] Int. Cl.[3] ..... B65H 17/20

[52] U.S. Cl. ..... 156/181; 28/107; 28/110; 156/148; 156/441; 226/193; 226/5

[58] Field of Search ..... 156/181, 167, 441, 436, 156/148, 167, 62.2, 62.4; 65/2; 28/107; 226/193, 190, 170; 19/286, 288, 301, 160

[56] References Cited

U.S. PATENT DOCUMENTS 3,883,333 5/1975 Ackley ..... 65/2

*Primary Examiner*—Michael W. Ball

*Attorney, Agent, or Firm*—John E. Curley

[57] ABSTRACT

A fiber glass mat making process is described which utilizes an improved method of transferring unbonded mat from a mat forming chain to a bonding station on a continuous basis.

The system involves passing the unbonded mat from a continuous conveyor surface to a roll which has on its surface a draped conveyor chain rotating around the roll but driven by the roll on which it is draped. By permitting the draped chain to hang freely below the roll and to rotate with the roll stray strands falling between the conveyor surface and the roll are returned on the draped chain to the feed end of the bonding station. Means are also provided to maintain the draped chain centered to insure that mat is delivered to the bonding station in a straight line from the conveyor surface.

4 Claims, 2 Drawing Figures

METHOD OF TRANSFERRING MAT FROM A FORMING SURFACE STATION TO A BONDING STATION

BACKGROUND OF THE INVENTION

In a process described in U.S. Pat. No. 3,883,333, continuous glass fiber strand mat is made on a forming conveyor and is fed to a mechanical needler which imparts mechanical integrity to the mat by rapidly penetrating the mat with barbed needles to thereby bond the glass strands. In the system shown in the above patent, two conveyors are employed, one on which mat is first formed and a second one which moves the mat through the needling machine. Occasionally, the mat being transferred from the forming chain to the needling machine falls between the main conveyor roll and the drive roll of the second conveyor which causes the mat to tear or become fouled on the conveyor roll on the second conveyor. If the fouling is particularly bad, this necessitates considerable downtime to move the needler drive roll so that the glass can be cut off of the main conveyor roll or the second conveyor rolls so that the process can be restarted. Further, considerable difficulty has been encountered in keeping the unbonded mat transferred from the main conveyor to the needler conveyor in a straight line and the mat material if it is fed into the needler in an off-center or non-straight mode causes excessive waste out of the needler due to the fact that most needled mat is edge trimmed to a precise width.

In an attempt to solve the problem of mat transfer, a system was proposed to utilize a grooved roll rather than a second conveyor to transfer mat to the needling device. The grooves in the roll were provided with fingers to lift the mat as it passed over the roll surface to assist in the transfer. This system failed in that glass strands tended to stick to the fingers and wrap around the needler feed roll causing more wraps than were experienced with the double conveyor belt system of the aforementioned patent.

Thus, a need still existed to provide an efficient method of transferring continuous strand mat from a forming conveyor to a bonding operation, such as a needling machine, which would minimize roll wraps at the transfer point and which would also provide a system that minimizes the downtime for the machinery should a roll wrap occur. There was also a need to provide system for conveying the mat from the mat forming conveyor to the bonding station in a straight path to minimize waste caused by misalignment.

The Invention

In accordance with the present invention a method is provided which permits continuous strand mat formed on a conveyor to be passed to a bonding station such as a needling machine with a minimum amount of difficulty. Thus the system is such that roll wraps between the main mat forming conveyor and the needling device for example, are kept to a minimum, while at the same time, the mat entering the needling device is kept in a straight line. Further, the simplicity of the method permits a roll wrap, should it occur, to be corrected quickly and efficiently, substantially reducing the downtime experienced with a double conveyor system such as described in the aforementioned U.S. Pat. No. 3,883,333.

The Present Invention

In accordance with the invention, unbonded continuous strand mat which has been formed on a continuous belt conveyor is moved along the conveyor to the end thereof and is transferred to a conveyor chain surface which rides on a single roll. The chain surface is part of an endless belt that is draped over the single roll and forms a loop below the roll. The chain is of a weight such that the pressure it exerts on the surface of the roll is sufficient to cause the chain to rotate with the roll in continuous movement when the roll is rotated. The ends of the chain drape are maintained in a straight line alignment on the roll surface by forcing the chain as it rotates between two guides located below and on both sides of the rotating roll over which the chain is rotating continuously.

The roll over which the chain is riding has a roller above it to apply some pressure to the continuous strand mat passing between the chain and the pressure roll. The chain draped roll is positively driven and can be varied in speed so that in conjunction with the pressure roll associated with it the conveying speed of the chain draped roll can exceed the main conveyor speed to provide at the point of transfer of the mat drafting of the mat coming off the main conveyor to control its density as will be described more fully hereinafter.

It has been found that the chain drape permits loose strands falling between the main conveyor and the draped roller to be picked up by the drape chain and they return to the chain surface rather than passing onto and fouling the main conveyor chain. Further, if a wrap does occur, the roller with the chain drape can be moved if necessary to permit the mat to be cut without the difficulty that this involves using a second conveyor.

DETAILED DESCRIPTION OF THE INVENTION

Figure 2:
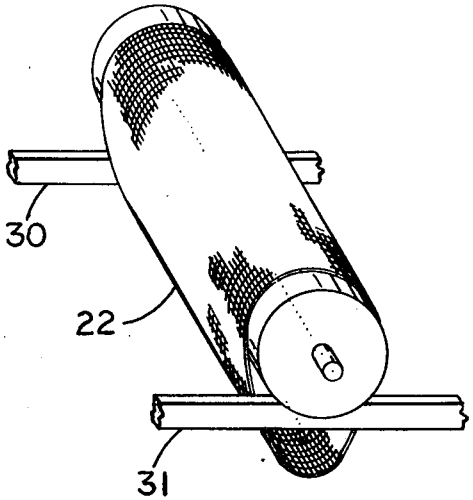
Figure 1:
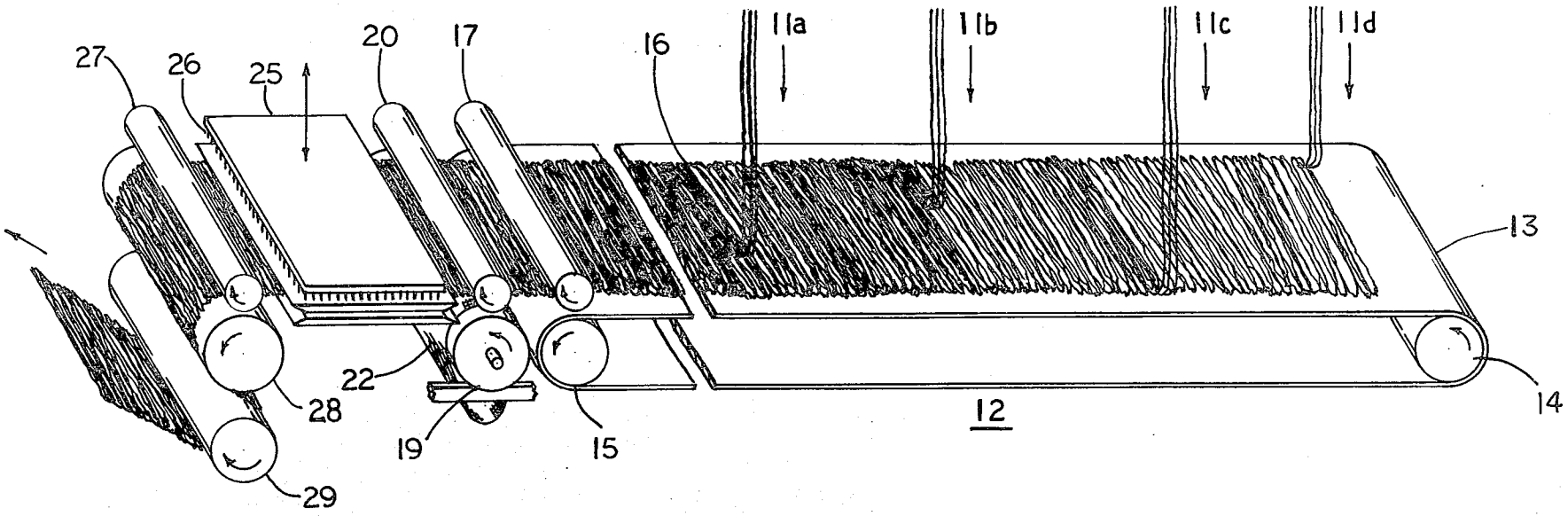

To more readily understand the instant invention, reference is made to the accompanying drawing which shows in FIG. 1, a side elevation of a mat making operation using the transfer mechanism of the invention and, FIG. 2, an isometric, enlarged view of the draped roll used to transfer mat.

As shown in FIG. 1, a plurality of fibrous strands 11*a*, 11*b*, 11*c*, and 11*d*, are fed to a conveyor, generally indicated as 12, which has an endless belt 13 which is continuously moved around rollers 14 and 15. A pressure roll 17 is placed on the mat 16 above the roller 15. The roller 15 in the main conveyor drive roll and pressure roll 17 is interconnected (not shown) to roll 15 to provide equal speed of both rolls 15 and 17. The mat 16 is passed between a second set of rolls as it leaves the belt 13. This set of rolls has a drive roll 19 and a free-wheeling pressure roll 20, aligned in parallel with each other. The pressure roll 20 engages mat 16 as it passes underneath it and applies pressure to mat 16 as it rides across the surface of a belt 22 which is draped across most of the width of the roll 19. The mat 16 after leaving the surface of belt 22 enters the needler 25 which is reciprocated continuously in an up and down fashion as indicated by the arrows on the drawing. The needles 26 are barbed and in penetrating the mat 16 in its passage through the needler 25 cause the strands in the mat 16 to move and entangle each other resulting in a mechanical bonding of the mat 16 in the needler 25. The mat 16 as it leaves the needler is passed between a free-wheeling pressure roll 27 and over a drive roll 28 and around a tension roll 29 which is also free-wheeling. The mat is then passed to a collection station (not shown) for packaging.

As shown in FIG. 2, roller 19 has an endless belt 22 draped around it. In the preferred embodiment this belt takes the form of a stainless steel mesh. The roller is driven off of shaft 19*a* which is connected to a belt and pulley arrangement associated with a suitable motor, not shown, but which is conventional in the conveyor art. Guide brackets 30 and 31 are placed near both ends of the roll 19 and below it to maintain the endless belt 22 centered on roll 19 to insure the mat 16 moves into the needler 25 in a straight path from the conveyor 12 and across roller 19 and its associated belt 22.

In the practice of the invention, strand mat may be prepared by feeding strands to the surface of the mat in the manner described in U.S. Pat. No. 3,883,333, which is incorporated herein by reference. Thus, to provide a glass mat, for example, fiber glass strands formed from a plurality of molten glass sources, known in the art as bushings, are traversed across the width of the conveyor surface to lay down the strands one above the other to establish a given density of mat on the conveyor surface. If a mat of synthetic fibers is being formed, the fibers from a spinnerette are fed in similar fashion as they emerge from the spinnerette. If desired strands can be traversed from packages of strands already formed by feeding the strands from the package and traversing them across the conveyor surface in a similar manner to the way strands are pulled from a bushing or spinnerette.

The endless belt 13 of the conveyor shown herein is preferably constructed of stainless steel mesh with the mesh opening being sized so that the strands ride on the surface thereof and penetration of strand into the openings of the mesh is minimized. Similarly the drape belt 22 is constructed of stainless steel mesh with the openings being small enough to prevent strand from entering them but open enough to permit cleaning with fluid spraying of accumulated dirt sizing or binder material normally present on strands used to manufacture mat products. Thus, both the main conveyor belt and the drape belt can be readily cleaned and serviced while providing a continuous surface for mat formation and transfer without becoming fouled by entrapped strands.

In a typical operation of the instant invention as shown in FIG. 1, a mat was formed by traversing a plurality of fiber glass strands from glass fiber forming packages across the width of conveyor 12 using a trasversing mesh as shown in U.S. Pat. No. 3,883,333 to provide a mat having a density of about 6 oz. per square foot on the endless belt 13. The endless belt 13 was a wire mesh chain having a wire mesh density of 42 links per square foot by 38 links per square foot. Drive roll 15 driven to provide a speed of 8.4±0.2 feet per minute. The distance between roll 15 and roll 19 was 4.5 inches and roll 19 was positioned slightly below roll 15 to provide an inclined path for the mat 16 passing from conveyor 13 to the chain drape 22. Pressure roll 17 was an 8½ inch diameter hollow steel roll. Feed roll 19 was a 6½ inch diameter steel roll having a chain belt, identical in mesh configuration to the belt 13 draped over its surface of roll 19 to a point below the main conveyor chain 13. Pressure roll 17 was a solid steel roll 7 inches in diameter. Roll 19 and roll 28 at the exit of the needler were positively driven by motors, not shown, to provide speed to the mat 16 passing through needler 25 of 14.4 ft. per minute. During several hours of operation of this unit, the glass mat successfully transferred without wraps on a continuous basis from the conveyor belt 13 through needler 25 with ease. Strands that tended to drop between the conveyor belt and the chain drape were observed to be caught on the surface of chain 22 and were pulled back onto the nip point between rolls 20 and 19 and moved through the needler. While the bonding operation is shown as a needler, it can of course be a chamber where resin is applied to bond the mat.

While the invention has been described with reference to certain specific embodiments thereof it is not intended to be limited thereby except insofar as appears in the accompanying claims.

I claim:

1. A method of transferring unbonded continuous strand mat from a moving mat forming surface to a bonding station comprising feeding the mat to the end of the moving forming surface, passing the mat from the forming surface to a rotating feed roller positioned in front of a bonding station, providing an endless belt over the surface of said feed roller, said belt hanging loosely from the roller surface, exerting sufficient pressure on the roller surface through the belt to cause the belt to rotate with the roller and moving the mat across the belt and associated roller to the bonding station.

2. The method of claim 1 wherein said mat forming surface and said belt are comprised of stainless steel mesh.

3. The method of claim 1 wherein the speed of the mat on said forming surface is slower than the speed of mat passing over the belt and feed roller to the bonding station.

4. The method of claim 1 wherein the belt riding over the surface of the feed roller is maintained at both ends of said roller a fixed distance from the ends thereof by forcing the belt to ride between guides positioned below the roller.

* * * * *